US005546677A

United States Patent [19]

Tolson

[11] Patent Number: 5,546,677

[45] Date of Patent: Aug. 20, 1996

[54] APPARATUS AND METHOD FOR SHRINKING FILM WRAPPED AROUND A PRODUCT

[75] Inventor: Sidney S. Tolson, Scotland Neck, N.C.

[73] Assignees: Ossid Corporation, Rocky Mount, N.C.; Ibaraki Seiki Machinery Co., Ltd., Osaka, Japan

[21] Appl. No.: 411,898

[22] Filed: Mar. 28, 1995

[51] Int. Cl.[6] ..... F26B 7/00; B65B 53/06

[52] U.S. Cl. ..... 34/216; 34/218; 53/442; 53/557

[58] Field of Search ..... 34/215, 216, 217, 34/218; 53/442, 557, 373.7, 373.8, 373.9

[56] References Cited

U.S. PATENT DOCUMENTS

| | | | |
|---|---|---|---|
| 3,309,835 | 3/1967 | Peppler | 53/442 |
| 3,534,393 | 10/1970 | Bickham et al. | 34/216 |
| 3,727,324 | 4/1973 | Melgaard | 34/216 |
| 3,777,446 | 12/1973 | Graver | 34/225 |
| 3,999,357 | 12/1976 | Marantz | 53/442 |
| 5,062,217 | 11/1991 | Tolson | 34/216 |
| 5,193,290 | 3/1993 | Tolson | 34/216 |
| 5,329,745 | 7/1994 | Suga | 53/450 |
| 5,398,427 | 3/1995 | Tolson | 34/216 |
| 5,421,139 | 6/1995 | Tolson | 53/450 |

*Primary Examiner*—James Larson
*Attorney, Agent, or Firm*—Olive & Olive, P.A.

[57] ABSTRACT

The apparatus and method of the invention provide a heat source adapted to direct heated air for shrinking a heat-shrinkable film wrapped around a package primarily to end seams of the package to avoid discoloration and distortion of printed central portions of film. The package is received by the apparatus with the end seams oriented transverse to the direction of travel. An arcuate conveyor section rotates the package 90° and onto a shrink tunnel conveyor. A pair of upwardly directed long nozzles which are oriented parallel to the travel direction of the shrink tunnel conveyor blow hot air at the end seams only, leaving the top and bottom central film portions to shrink slowly by contact with warm ambient air in the tunnel.

11 Claims, 3 Drawing Sheets

APPARATUS AND METHOD FOR SHRINKING FILM WRAPPED AROUND A PRODUCT

FIELD OF THE INVENTION

This invention relates to an apparatus and method for the shrinking of heat-shrinkable film wrapped around a product.

BACKGROUND OF THE INVENTION

Many products are wrapped in a heat-shrinkable film which is subsequently shrunk by the application of heat. Often the enclosed product is visible through this film and the appeal to the prospective purchaser is somewhat dependent on the package appearance. The film is typically preprinted with the producer's name, producer's logo and other information of interest to the consumer. Efforts have been made in the past to improve the package being displayed for sale by assuring that the film appears with few or no wrinkles and is preferably tightly fitted around the enclosed product.

Some examples of known methods for the shrinking of heat-shrinkable film are disclosed in U.S. Pat. No. 5,062,217 for a SELECTIVE SEQUENTIAL SHRINK APPARATUS AND PROCESS; U.S. Pat. No. 5,193,290 for an APPARATUS AND METHOD FOR SEQUENTIAL SHRINKING OF PACKAGING FILM; and U.S. Pat. No. 5,398,427 for an APPARATUS AND METHOD FOR DIFFERENTIALLY SHRINKING SELECTED PORTIONS OF HEAT SHRINKABLE FILM WRAPPED AROUND A PRODUCT, all to the present applicant, the teachings of which are incorporated herein by reference.

Recent changes in the laws and regulations governing packaging and labelling of meat products require that each package be marked with safe handling and cooking procedures, and that the print be clear and readable. In the interest of compliance and consumer relations, processors of poultry parts, in particular, have been seeking a package print which after being shrunk exceeds the readability requirement and is sharp and bold. To achieve that level of packaging print quality, it is both necessary to shrink the preprinted heat-shrinkable film without forming wrinkles and to cause the printed portions to be protected from heat-induced discoloration or distortion.

In another aspect of the prior art, a widely used method of film wrapping a product results in a longitudinal bottom seam and a transverse seam at the leading and trailing ends of the package. The present invention is directed to this form of packaging. As one embodiment of this form of packaging and in response to the new laws and regulations, applicant's copending patent application Ser. No. 08/225,822 filed Apr. 11, 1994, entitled METHOD OF MAKING A FILM WRAPPED PRODUCT HAVING AN OFF-CENTER SEAM, now U.S. Pat. No. 5,421,139, teaches a method for off-setting the bottom longitudinal seam to better facilitate the placement of printed information regarding storage, cooking instructions, etc.

It is therefore an object of this invention to provide an apparatus and method for the shrinking of heat-shrinkable film wrapped around a product which results in a wrinkle-free finished package appearance.

A further object of the invention is to provide an apparatus and method for the shrinking of preprinted heat-shrinkable film wrapped around a product in a manner which minimizes the discoloration and distortion of print on the film.

An additional object of the invention is to provide an apparatus and method for the shrinking of preprinted heat-shrinkable film wrapped around a product without causing wrinkles.

Other objects and advantages will be more fully apparent from the following disclosure and appended claims.

SUMMARY OF THE INVENTION

The apparatus and method of the invention are for shrinking film which has been wrapped around a product by the wrapping method which produces a longitudinal bottom seam and a transverse seam at each of the leading and trailing ends. A pneumatic cylinder pushes the package from a linear conveyor onto an arcuate conveyor. The arcuate conveyor receives the wrapped package from the wrapping apparatus and rotates the package 90° and discharges the package onto a shrink tunnel conveyor so that the transverse seams are positioned parallel to the original direction of travel of the linear conveyor. The heat source in the shrink tunnel includes a pair of opposed, spaced apart, long, thin nozzles oriented parallel to the direction of conveyor travel. The nozzles can be adjusted to align their respective nozzles with the transverse seams and thereby concentrate maximum heat on the ends of the film wrap. Other areas of the film are moderately shrunk by exposure to ambient heated air within the shrink tunnel, without any direct blast of concentrated hot air.

DETAILED DESCRIPTION OF THE INVENTION

Figure 1:
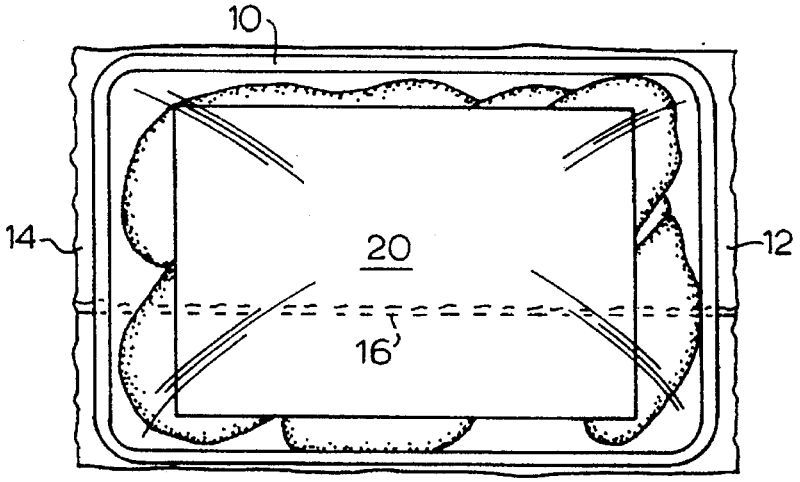
FIG. 1 is a top plan view of a film wrapped package having an identifying print panel thereon.
Figure 2:
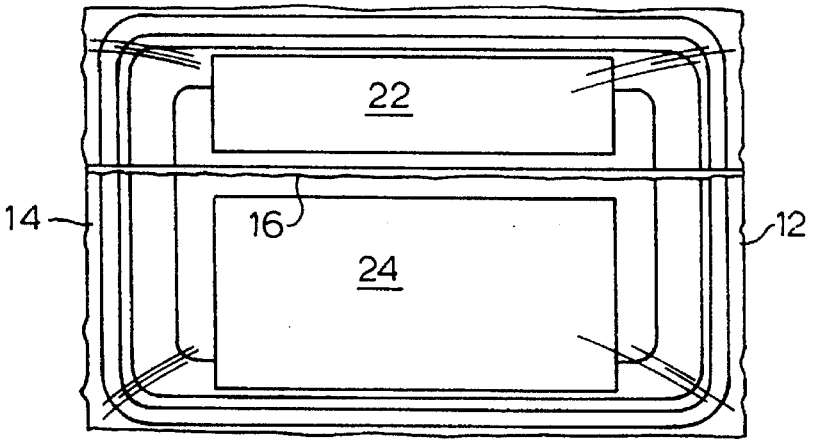
FIG. 2 is a bottom plan view of the film wrapped package of FIG. 1 having two information print panels thereon.

A product wrapped in a heat-shrinkable film is illustrated in a top plan view in FIG. 1 and in a bottom plan view in FIG. 2. Package P comprises tray 10 which contains a product for example poultry parts, and is wrapped in a heat-shrinkable film which is sealed by leading transverse seam 12, trailing transverse seam 14 and a bottom longitudinal seam 16. A package wrapping machine able to wrap a product in a heat-shrinkable film so as to form a longitudinal bottom seam and a pair of transverse end seams is disclosed in U.S. Pat. No. 5,329,745 to Suga, which is incorporated herein by reference. The film, prior to being wrapped around tray 10, is printed with top panel 20 which typically includes the name of the producer or supplier, first bottom panel 22 which typically includes a recipe or cooking instructions and second bottom panel 24 which typically includes storage and handling instructions. The bottom longitudinal seam 16 is illustrated in FIG. 2 as being positioned off center with respect to tray 10, however a package with a centrally located bottom seam would similarly benefit from the present invention.

Figure 3:
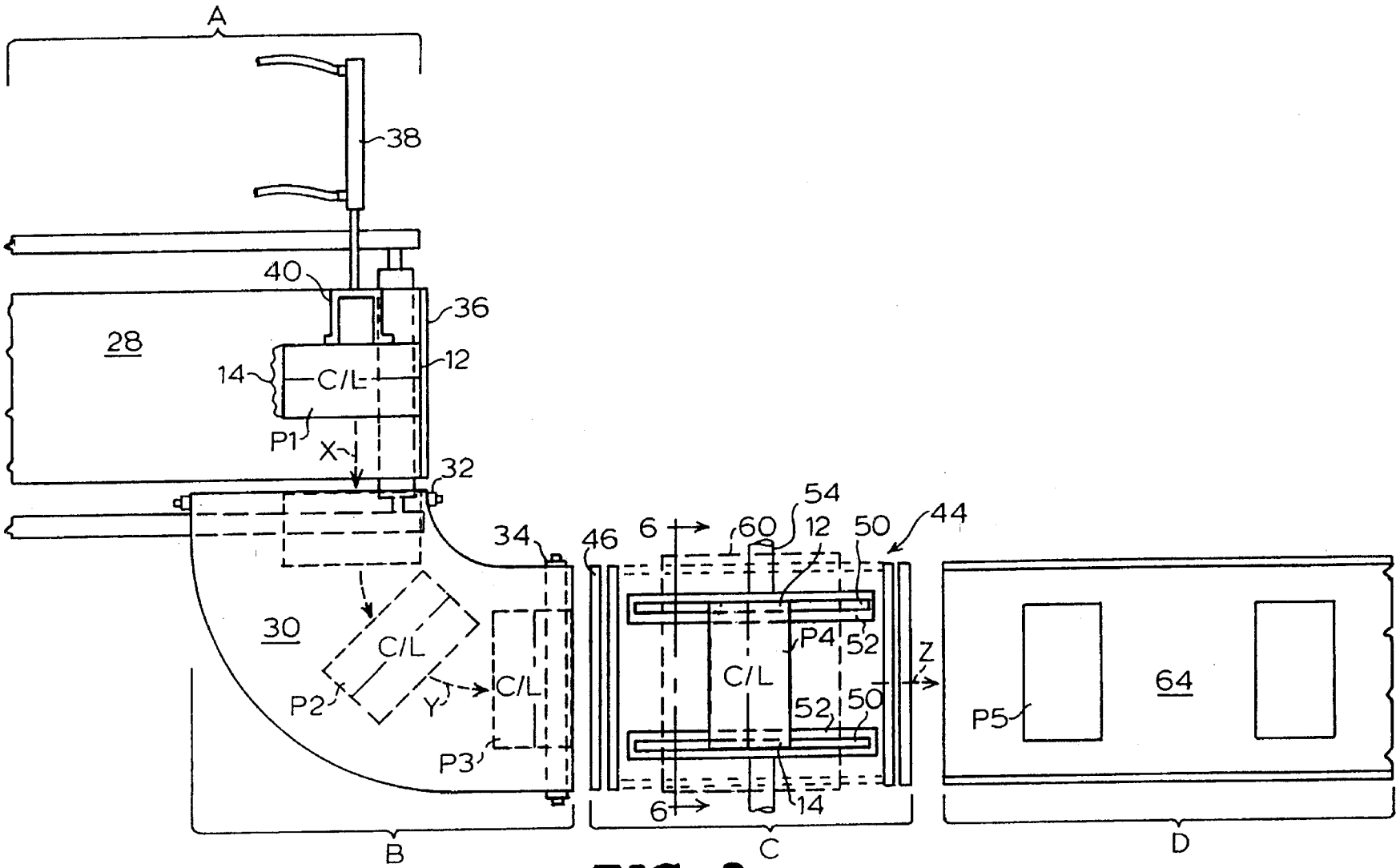
FIG. 3 is a schematic top plan view of the apparatus of the invention and illustrating the method of the invention being practiced on a film wrapped tray of poultry.

The apparatus and method of the invention are schematically illustrated in FIG. 3. A first step (marked as section A) involves receiving a product wrapped in a heat-shrinkable film on a conveyer, a second step (section B) involves transferring the package to a second conveyer for rotating the wrapped product 90°, a third step (section C) involves shrinking the film near its transverse end seams and a fourth step (section D) involves discharging the finished package. A series of packages P are identified as P1–P5 in order of their respective progress through the apparatus of the invention. A wrapping machine according to the '745 patent transports wrapped package P1 on outfeed conveyer 28 to stop 36. Pneumatic cylinder 38 is caused to extend which in turn moves its attached push bar 40 to move package P1 in the direction of arrow X onto arcuate conveyer 30. Arcuate conveyer 30 is formed from a conical belt and a pair of rollers 32 and 34 which are oriented at an angle of approximately 90° to each other. As arcuate conveyer 30 moves package P1 through a quarter circle path in the direction indicated by arrow Y, the package is represented sequentially as package P2 and package P3. After having been thus rotated, end seams 12, 14 of package P3 are oriented parallel to the direction of travel of shrink tunnel conveyer 44, indicated by arrow Z. Package P3 is now oriented so it will pass from arcuate conveyer 30 to shrink tunnel conveyer 44. Package P4, which represents a package (such as package P3) which has entered the shrink tunnel 60, then travels throughout the length of conveyer 44 with transverse end seams 12, 14 following a pair of parallel paths a known distance from the center of conveyer 44. Whereas the rotation of package P3 readily permits a straight line conveyer path from the 90° arcuate conveyer 30 to the end of the process, the principles of the invention encompass use of angular conveyor paths with a different degree of rotation or in some instances no package rotation may be needed. That is, any form of application of heat directed principally towards the transverse end seams as the package is conveyed along a path parallel to the transverse end seams provides the objective shrink area control. Package P5, which represents a package which has exited the shrink tunnel, continues on discharge conveyor 64 in discharge section D to enter a weighing and labeling operation (not shown). Finally, the finished and labelled packages are moved to a cannon packing station (not shown).

Figure 4:
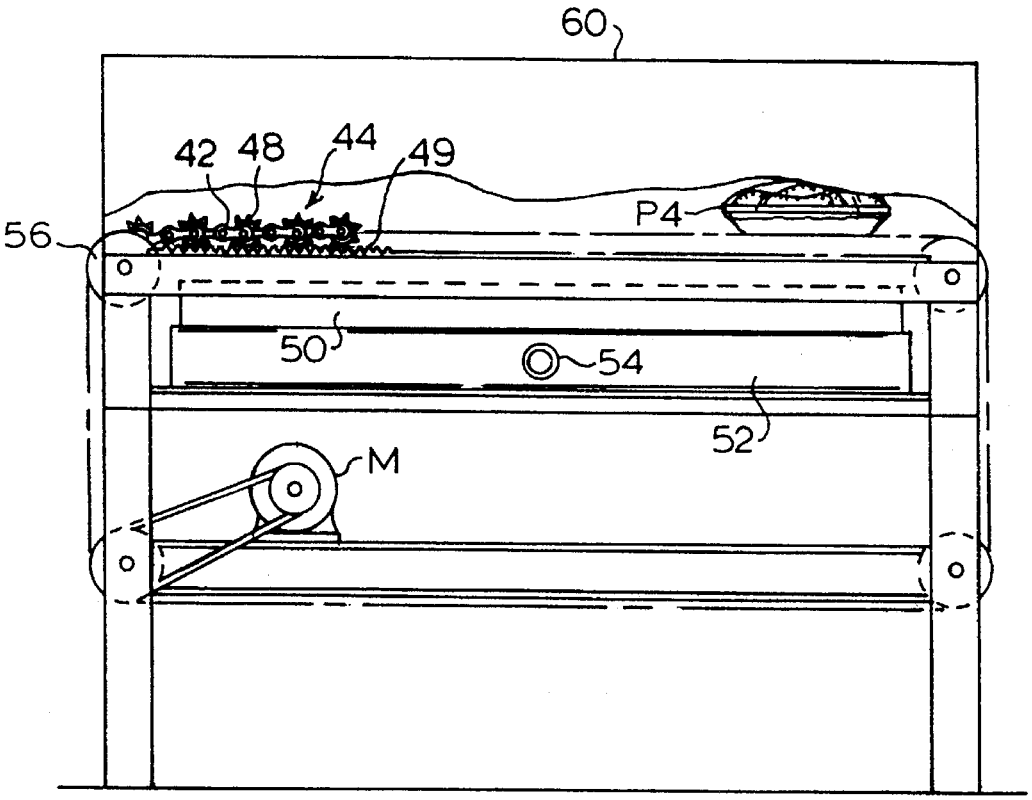
FIG. 4 is a side elevation view of the shrink tunnel conveyor apparatus and showing the heat nozzles of the invention.
Figure 5:
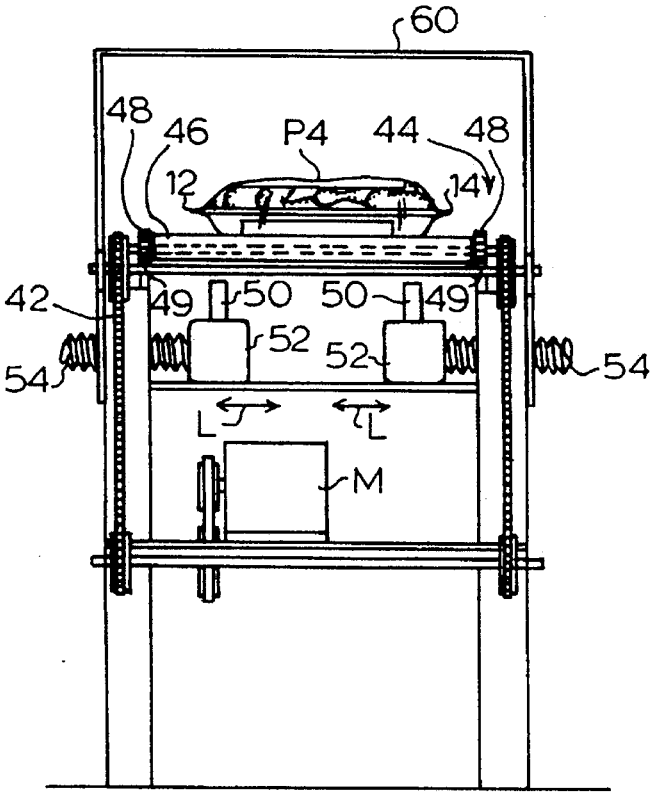
FIG. 5 is an end elevation view of the shrink tunnel conveyor apparatus of FIG. 4.

Referring now to FIGS. 4 and 5, shrink tunnel conveyor 44 is a conveyor having a series of rollers 46 rotatably connected on each end thereof to a chain 42 with a space between each pair of adjacent rollers 46 which space is preferably of greater width than the diameter of each roller. The top horizontal run of conveyor 44 is the transport run for moving representative package P4 through shrink tunnel 60. Rollers 46 are made of an insulating material which is able to tolerate high temperature without transferring much heat by conduction to the wrapping film and which does not tend to adhere to the film. Each roller 46 is preferably mounted on a shaft with a pinion 48 affixed on each end. Each pinion 48 is in contact with a rack 49 so that as conveyor 44 is moved around frame-mounted rollers 56 by motor M, racks 49 and pinions 48 cause each roller 46 to revolve about its axis. In this manner, package P4 is moved in a forward direction over rollers 46 and all portions of the bottom of package P4 have exposure to the directed hot air stream flowing between adjacent rollers 46 from below as will be described further.

A pair of hot air plenums 52 are symmetrically placed within the loop formed by conveyor 44 with hot air nozzles 50 directed upward in close proximity beneath rollers 46. Nozzles 50 are formed as narrow channels so as to focus the hot air stream in a narrow path. Plenums 52 are supplied with hot air from a suitable source through flexible hot air ducts 54 and plenums 52 are adjustable laterally (note arrows L) to enable positioning nozzles 50 as best to impinge the hot air stream on end seams 12, 14 without directly contacting the bottom areas of film around package P4 (see FIG. 6). By such narrow contact of hot air, or an alternate heat medium able to be narrowly directed, on the heat-shrinkable film close to its end seams, distortion and discoloration of printing on the bottom 58 of the film is virtually avoided. The balance of heat-shrinkable film surrounding package P4 is caused to shrink more slowly by being immersed in warm air within heat tunnel 60 (illustrated in dashed lines), resulting in a completely shrunk film with little or no wrinkles. In the preferred embodiment, shrink tunnel 60 is open on its bottom, thus permitting the blending of ambient room air and heated air from hot air nozzles 50 in the vicinity of the heat-shrinkable film. A further purpose of the open bottom of shrink tunnel 60 is to permit rollers 46 to move outside of shrink tunnel 60 and be exposed to relatively cool air and thus stay cool enough to avoid causing excess shrinkage of the film when they contact the wrapping film.

Figure 6:
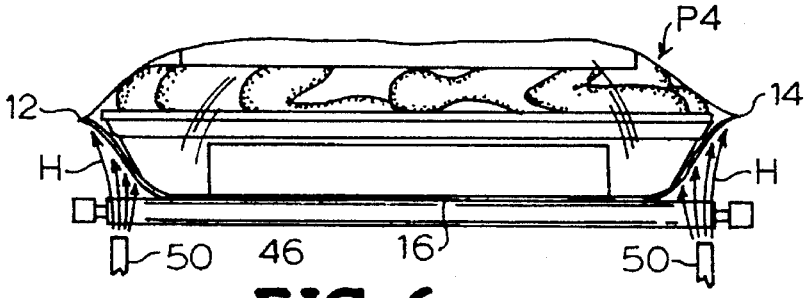
FIG. 6 is an enlarged elevation view of a package wrapped in a heat-shrinkable film and illustrating the transverse end seams being impinged according to the invention by hot air directed by a pair of nozzles from below.

A greater detail of the flow of hot air H from nozzles 50 to the heat-shrinkable film in the vicinity of lead transverse seam 12 and trailing transverse seam 14 is shown in FIG. 6. Nozzles 50 are configured as relatively tall, relatively narrow channels through which hot air is blown as a package P is transported by a series of conveyor rollers 46. The tall, narrow configuration of nozzles 50 enables hot air H to follow a comparatively narrow path and apply heat to the end portions of package P, while not applying heat to the central bottom portion thereof. In this process, the typical upwardly-tapered contour of tray 10 is utilized to direct the flow of the hottest air away from the more sensitive bottom areas of film.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An apparatus for shrinking a heat-shrinkable film wrapped around a product in a manner to substantially avoid discoloration and distortion of such film, comprising:

(a) means for receiving in a first orientation, a package wrapped in heat-shrinkable film sealed with a longitudinal bottom seam and a pair of transverse end seams;

(b) means for repositioning said package from said first orientation to a second orientation in which said transverse end seams are exposed for being heated;

(c) means for moving said package while in said second orientation into and through a shrink tunnel; and (d) a source of heat directed at each of said transverse end seams as said package is transported through said shrink tunnel.

2. The apparatus for shrinking a heat-shrinkable film wrapped around a product as claimed in claim 1, wherein said means for repositioning said package comprises an arcuate conveyor.

3. The apparatus for shrinking a heat-shrinkable film wrapped around a product as claimed in claim 1, wherein said means for moving said package through said shrink tunnel comprises a perforate conveyor having a transport run extending through said shrink tunnel.

4. The apparatus for shrinking a heat-shrinkable film wrapped around a product as claimed in claim 1, wherein said heat source comprises a pair of hot air conducting plenums having nozzles capable of being positioned to direct hot air at said transverse seams.

5. The apparatus for shrinking a heat-shrinkable film wrapped around a product as claimed in claim 3, wherein said shrink tunnel has an open bottom and said perforate conveyor is arranged such that said transport run travels within said shrink tunnel above said open bottom and other portions of said perforate conveyor travel below said shrink tunnel open bottom.

6. The apparatus for shrinking a heat-shrinkable film wrapped around a product as claimed in claim 5, wherein said perforate conveyor comprises a series of spaced apart rotatably driven rollers connected together to transport said package over said open bottom and to permit heat to pass therethrough.

7. A method for shrinking a heat-shrinkable film wrapped around a product in a manner so that said film is subject to a minimum of discoloration and distortion, comprising the steps of:

(a) supplying to a first location a package wrapped with said heat-shrinkable film so as to have a longitudinal bottom seam oriented substantially parallel to the path of a shrink tunnel conveyor and a transverse seam at each end oriented substantially perpendicular to said path;

(b) repositioning said package while moving from said first location to a second location laterally offset from said first location so that at said second location said transverse seams are oriented substantially parallel to said path and are exposed for being heated;

(c) transporting said repositioned package along said path with said transverse seams parallel thereto;

(d) directing a stream of hot air at each of said transverse seams while said package is conveyed by said conveyor so as to cause said film adjacent said transverse seams to shrink; and (e) discharging said package from said conveyor.

8. The method for shrinking a heat-shrinkable film wrapped around a product as claimed in claim 7, further comprising the step of immersing said package in warm air so as to shrink portions of said film other than said film adjacent said transverse seams comparatively slowly.

9. An apparatus for shrinking a heat-shrinkable film wrapped around a product in a manner to substantially avoid discoloration and distortion of printed areas on upper and lower portions of such film, comprising:

(a) means for receiving a package wrapped in heat-shrinkable film sealed with a longitudinal bottom seam and a pair of transverse end seams;

(b) means for moving said package into and through a shrink tunnel so that said transverse end seams are oriented parallel to the direction of travel through said shrink tunnel; and (c) a source of hot air directed at each of said transverse end seams as said package is transported through said shrink tunnel.

10. Apparatus for shrinking selected portions of a heat-shrinkable film, comprising:

(a) means for receiving a package wrapped in said heat-shrinkable film so as to have a pair of mutually parallel end seams positioned substantially perpendicular to the direction of travel of a conveyor, said conveyor being laterally offset from said means for receiving;

(b) means for repositioning said package on said conveyor so that said end seams are oriented substantially parallel to the direction of travel of said conveyor; and (c) a heat source adapted for applying heat in the vicinity of said end seams at a temperature sufficient to cause said heat-shrinkable film to shrink as said package is transported by said conveyor while said end seams are oriented substantially parallel to the direction of travel of said conveyor.

11. Apparatus for shrinking selected portions of a heat-shrinkable film as claimed in claim 10 wherein said conveyor is comprised of a series of rotatable conveyor rollers separated from one another by a series of spaces.

* * * * *

UNITED STATES PATENT AND TRADEMARK OFFICE

CERTIFICATE OF CORRECTION

PATENT NO. : 5,546,677
DATED : August 20, 1996
INVENTOR(S) : Sidney S. Tolson

It is certified that error appears in the above-indentified patent and that said Letters Patent is hereby corrected as shown below:

Column 3, line 46, correct "cannon" to read --carton--.

Signed and Sealed this

Twenty-second Day of October, 1996

*Attest:*

Bruce Lehman

BRUCE LEHMAN

*Attesting Officer*

*Commissioner of Patents and Trademarks*